US005299401A

United States Patent [19]

Shelton

[11] Patent Number: 5,299,401

[45] Date of Patent: Apr. 5, 1994

[54] ATHLETIC FLOORING SYSTEM

[76] Inventor: Floyd Shelton, 803 Jefferson St., Wausau, Wis. 54401

[21] Appl. No.: 12,943

[22] Filed: Feb. 3, 1993

[51] Int. Cl.[5] ..... E04F 15/02

[52] U.S. Cl. ..... 52/393; 52/403; 52/480

[58] Field of Search ..... 52/393, 391, 403, 480, 52/782

[56] References Cited

U.S. PATENT DOCUMENTS

| | | | |
|---|---|---|---|
| 3,828,503 | 8/1974 | Hofmann | 52/393 |
| 4,443,989 | 4/1984 | Silvey et al. | 52/393 X |
| 4,644,720 | 2/1987 | Schneider | 52/403 X |
| 4,879,857 | 11/1989 | Peterson et al. | 52/480 X |
| 4,890,434 | 1/1990 | Niese | 52/393 |
| 5,016,413 | 5/1991 | Coonihan | 52/391 |

*Primary Examiner*—Carl D. Friedman
*Assistant Examiner*—Robert J. Canfield
*Attorney, Agent, or Firm*—Russell L. Johnson

[57] ABSTRACT

The invention is for an athletic flooring system wherein the flooring substructures are proportioned and positioned so as to give to the flooring system preferred properties in point and area elasticity. The subfloor is made up of a first and a second wood subfloor wherein the first subfloor is less continuous and more elastic than the second subfloor. The subfloors act in cooperation with a pad and with void volumes distributed in the subfloor to give the flooring system elastic properties that will render the flooring system DIN certifiable under the DIN 18032, part 2, tests.

5 Claims, 4 Drawing Sheets

ATHLETIC FLOORING SYSTEM

FIELD OF THE INVENTION

This invention relates to athletic floors.

More specifically this invention relates to the combination of elements that make up the substructures that underlay athletic floors.

Still more specifically, this invention relates to the sizes, and positioning of the elements that are used to create substructures for athletic floors and to their proportional relationship to each other.

BACKGROUND OF THE INVENTION

Historically, wood has been the preferred material for athletic floors for indoor athletic venues such as gymnasiums, handball courts and the like. The structure of such flooring systems can be generally described as comprising; a bottom base, typically of concrete, a middle layer of structures referred to generally as the substructures, and the top surface which is the wood flooring. This invention relates to substructures for such flooring systems.

As the sophistication of athletics has grown, so has the development of the art and science of designing substructures for athletic floors. The substructures of athletic floors contribute significantly to the physical properties of the finished athletic floor. The athletic flooring industry has adopted a method for measuring both point elasticity and area elasticity of athletic floor constructions in terms of such factors as force attenuation, standard deformation, deformation trough, rolling load, and ball rebound, as percentages of established norms. United States Sports Labs. conducts tests to measure these properties of sports floors and to use the data taken to rate the floors. One such test that is widely accepted in the sports floor industry is the DIN 18032, Part II, test, (DIN). A DIN certification is given to floors that achieve satisfactory scores in the above described tests. The standards for DIN resting are set out in a paper titled DIN 18032 Part 2 (March 1991) as translated from the German, by Hans J. Kolitzus 1ST/USSL April 1992.

Acquiring certification under the DIN 18032 Part 2 requirements involves a series of tests and measurements done by a certified tester, under specified conditions, using specified methods and equipment.

For each of the categories of tests a specified number of measurements are taken and the results computed and averaged. The average result for each category of test must then meet the requirements for DIN certification in that category.

Force Attenuation is a measure of the force reduction achieved by a test floor as a percent of the force reduction achieved by a standardized rigid floor (steel over cement on compacted earth). The DIN test involves a dropped test weight acting through a spring loaded force transfer instrument. The force reduction is computed as a percent as; (1-Fmax test/Fmax stand.)×100. For certification that value must be a minimum of 58%.

Standard Deformation is a measure of the vertical displacement of a test floor in response the impact of a dropped weight, measured at the location of the dropped weight on the test floor. Standard deformation is measured in millimeters and is computed by a formula that contains correction factors. For DIN certification, the computed standard deformation must be between 3.0 mm. minimum, and 5.0 mm. maximum.

Deformation Trough is a measure of vertical displacement of a test floor at 500 mm. from the location of impact of a draped weight. Deformation trough is computed as a percentage of the displacement of the floor at the location of impact. A maximum percentage of 5% is permitted for DIN certification.

Rolling Load is a measure of the effects of a weighted test wheel which is rolled over defined strips on the test floor a prescribed number of times (300 passes). The test floor is then cut up and examined. For DIN certification, no damage to the floor or its substructure can be found and any remaining impressions must be less than 0.5 mm.

Ball Rebound is a measure of the rebound of a standardized basketball dropped from a set height on a test floor and is computed as a percentage of the rebound of the basketball from a rigid floor. For DIN certification, the percentage must be a minimum of 90%.

The DIN test contains other measures such as, Sliding Coefficient, which are concerned with properties other than those significantly influenced by the flooring system of this invention.

Many of the substructures in use in the past do not yield an athletic floor that will perform at a level that will earn a DIN certification. As a result there has been a flurry of creative activity in the athletic flooring industry wherein many of the competitors have developed sophisticated and often more expensive substructures for athletic floors in order to achieve a desirable DIN certification.

As a result of this creative activity, many of the old reliable substructures that have shown their merit over the decades, have been abandoned. This invention relates to creative and unobvious improvements in such old reliable substructures which configure them so as to achieve a DIN certification.

BRIEF DISCUSSION OF THE PRIOR ART

For many decades a common athletic floor combination has been one wherein the base is first overload with a resilient pad, hereinafter "pad", a first layer of subflooring", hereinafter "first subflooring layer, a second subflooring layer intersecting the first layer of subflooring, hereinafter "second subflooring layer", and the first and second subflooring layers are fastened together, and are overload with a top layer of outer flooring fastened to the substructure to provide an athletic flooring system.

The above description represents the closest prior art known to the inventor and represents the substructures upon which his improvements have been made.

U.S. Pat. No. 4,890,434, to Niese teaches a flooring system wherein the DIN 18032 Part II is described in detail.

The applicant has discovered that the DIN rating of a flooring system can be improved by means of modifying the size, number, and proportions of the elements of the substructures of some traditional flooring systems.

The improvement being, to raise the DIN rating of flooring systems using old combinations of proven and economical components, by modifying the proportions and spacings of the components to create new combinations of old elements that do achieve the desired DIN certification.

OBJECTS

It is an object of this invention to provide an improved substructure for flooring systems, of the pad, and two wood subfloors type, wherein the improvement lies in changing the number and dimensions of the components of the system.

It is further an object of this invention to provide the improved system described above wherein the improvement further lies in the novel sizing and spacing of the elements so that the first subfloor is more flexible than the second subfloor.

It is further an object of this invention to provide the improved system described above wherein the improvement further lies in the novel proportional relationships between the elements of the system.

Other objects will become apparent from the following specifications, drawings, and claims.

BRIEF DESCRIPTION OF THE INVENTION

The invention in its simplest form is an improved athletic flooring system comprising;

a) a base, b) a resilient pad, c) a first wooden subflooring layer, d) a second wooden subflooring layer wherein the first subflooring layer is more flexible than the second subflooring layer, e) distributed void volumes that are a part of at least one of the lower layers of the substructure, f) a top flooring layer of hardwood boards secured to the subflooring, and g) the flooring system is DIN certifiable under DIN 18032 Part 2 certification procedures.

DETAILED DESCRIPTION OF THE INVENTION

Figure 1:
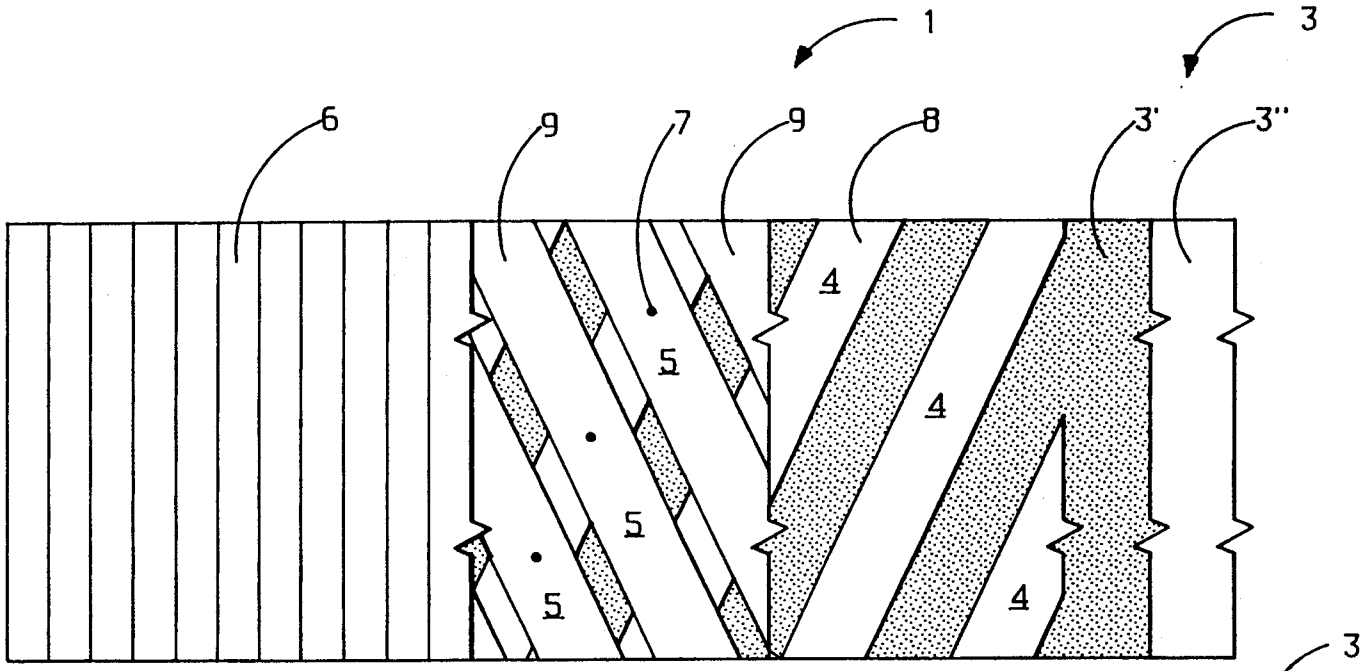
FIG. 1 is a partially sectioned plan view of an improved flooring system made according to this invention.

In the drawings like numbers refer to like objects and the proportions of some elements has been exaggerated for clarity of illustration. It is to be understood that where specific dimensions are given, those dimensions are to include the range of variance customarily given in the art to such dimensions.

In one typical, prior art, athletic flooring system of the base; pad; first wood subfloor-second wood subfloor; outer floor, type, the base might be of concrete or asphalt, the pad might be of half inch thick closed cell resilient polyethylene foam, and the subflooring might typically be of spruce-pine-fir (SPF). The first and second subfloors might typically be made up of nominal 1" by 6" boards which are set at approximately 25° to a long side of the floor with a 1"-2" separation between boards, and the first and second subfloors are laid so that the boards of the first subfloor cross the boards of the second subfloor and the two subfloors are joined to each other by means of conventional fasteners such as nails, staples, and screws. The outer floor is typically of a quality hardwood, with maple being the preferred wood.

In a second typical, prior art, athletic flooring system of the base; pad; first wood subfloor; second wood subfloor; outer floor, type, the first and second wood subfloor layers are formed of crosslaid 4' by 8' by ½" plywood sheets and the pad is formed of discreet small individual resilient pads which are secured to the bottom face of the first subfloor layer in a grid pattern. Typically, individual pads of two different durometers are used to make up the grid pattern for the pad layer, and the individual pads of differing durometer are placed alternately in the grid pattern of the pad configuration.

Neither the first or the second commonly used subflooring assemblies, as described above have been found to be DIN certifiable. However, the inventor has found that the same materials of given different dimensions and positioned differently, can in some fairly narrowly defined combinations produce a flooring system with DIN ratings sufficient to be DIN certifiable and further, to do so at a cost lower than that of the traditional systems described above.

Figure 2:
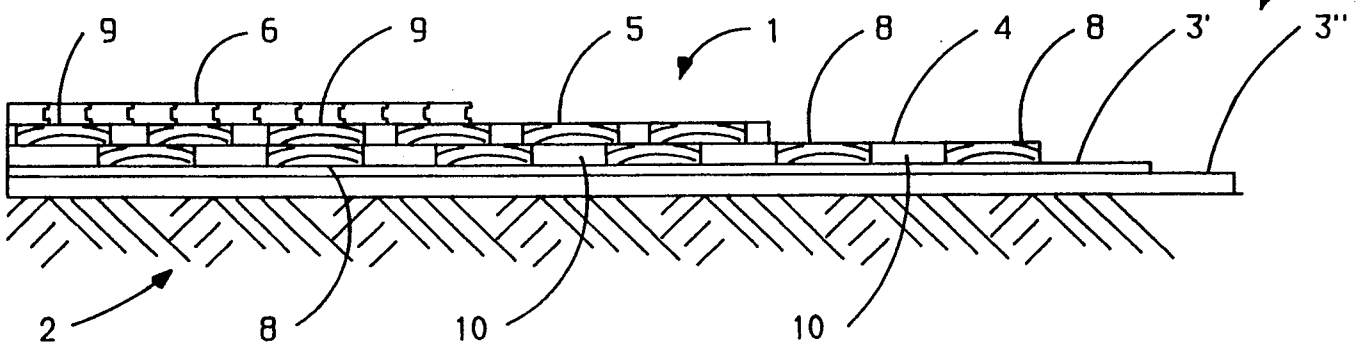
FIG. 2 is an elevational view of the flooring system of FIG. 1.
Figure 3:
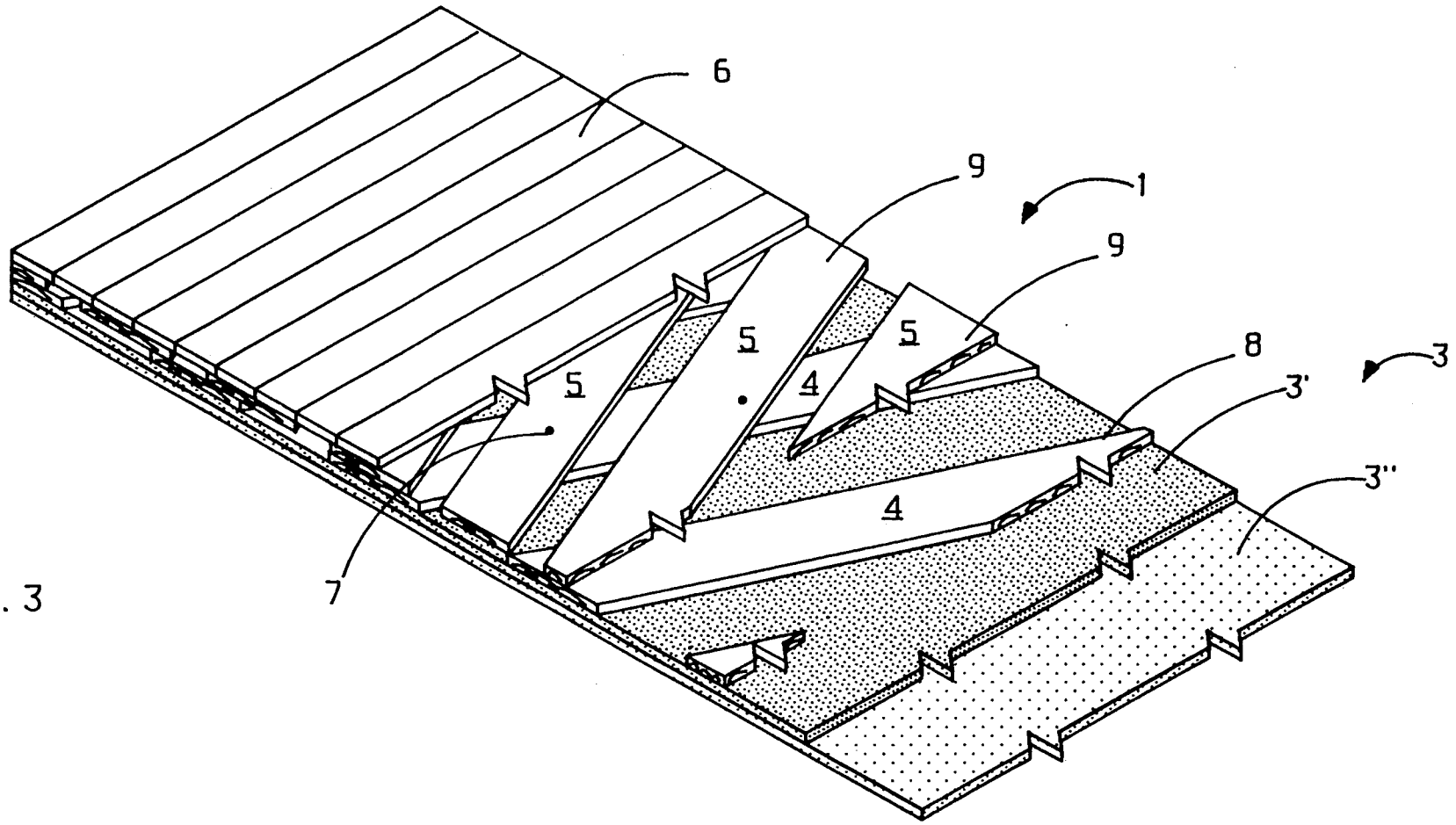
FIG. 3 is a partially sectioned pictorial view of the flooring system of the system of FIGS. 1 and 1.

FIGS. 1, 2, and 3 show a flooring system of the first type described above, but wherein critical changes have been made to the dimensions, the positional relationships and the proportions of the components of the system whereby the cost of the system is reduced and the performance of the system has been found to be DIN certifiable.

The flooring system 1, of this invention comprises a base 2, a pad 3, a first subfloor 4, a second subfloor 5 and an outer floor 6. Subfloor 5 is secured to subfloor 4 by means of conventional fasteners 7 and outer floor 6 is joined to the joined subfloors by means of conventional fasteners (not shown).

The DIN test measures the properties of the total system. The contributions of the sizes, shapes and proportions of the components of the system are synergistic and imperfectly understood. However, some proportional relationships have been imperically arrived at by the inventor and these relationships form a basis for defining the boundaries between which are found the sizes and proportional relationships of the components that produce the unexpected results that enable the flooring systems of this invention to achieve satisfactory DIN results.

A pad in a conventional installation of the type contemplated by this invention, would be in the order of one half inch thick and be of resilient foam. The pad 3 of this invention is greater than one half inch thick and less than the thickness of the combined thickness of the first subfloor 4 and second subfloor 5. In preferred embodiments pad 3 is assembled of more than one pad as shown at 3' and 3".

In a conventional athletic floor substructure, of the type contemplated by this embodiment of the invention, the first and second subfloors would be assembled of boards that are roughly ¾" by 5½" wooden boards and the boards would be spaced apart, typically at a distance of 1"-2" and the boards would cross each other, typically at an angle of 50°.

The boards 8 of first subfloor 4 of this invention are spaced apart a distance at least twice the distance of boards 9 of second subfloor 5. The wide spacing of boards 8 of first subfloor 4 along with the relatively narrow spacing of boards 9 of second subfloor 5 in cooperation with the resilience of pad 3 and the distributions of the void spaces 10, contribute synergistically to the elastic properties of the flooring system and to the achievement of an improved DIN rating over that achieved by the above referred to conventional system.

It has been found that if the thickness of boards 8 and 9 are reduced, the thickness of pad 3 can be reduced in proportion, and still achieve a satisfactory DIN rating. For example; it has been found that a DIN certification is achievable in a flooring system wherein 5½" boards of ½" thickness are used in combination with a pad of ¾" thickness and wherein the boards of first subfloor 4 are spaced 6" apart and the boards of second subfloor 5 are spaced 2" apart thereby rendering the first subfloor more flexible than the second subfloor. It should be noted that this flooring system provides a superior DIN rating than the conventional flooring system of the same type while achieving a reduction in the number of board feet of wood used in the subfloor by approximately 40%, thereby providing a flooring system of superior performance at a greatly reduced materials cost.

Figure 4:
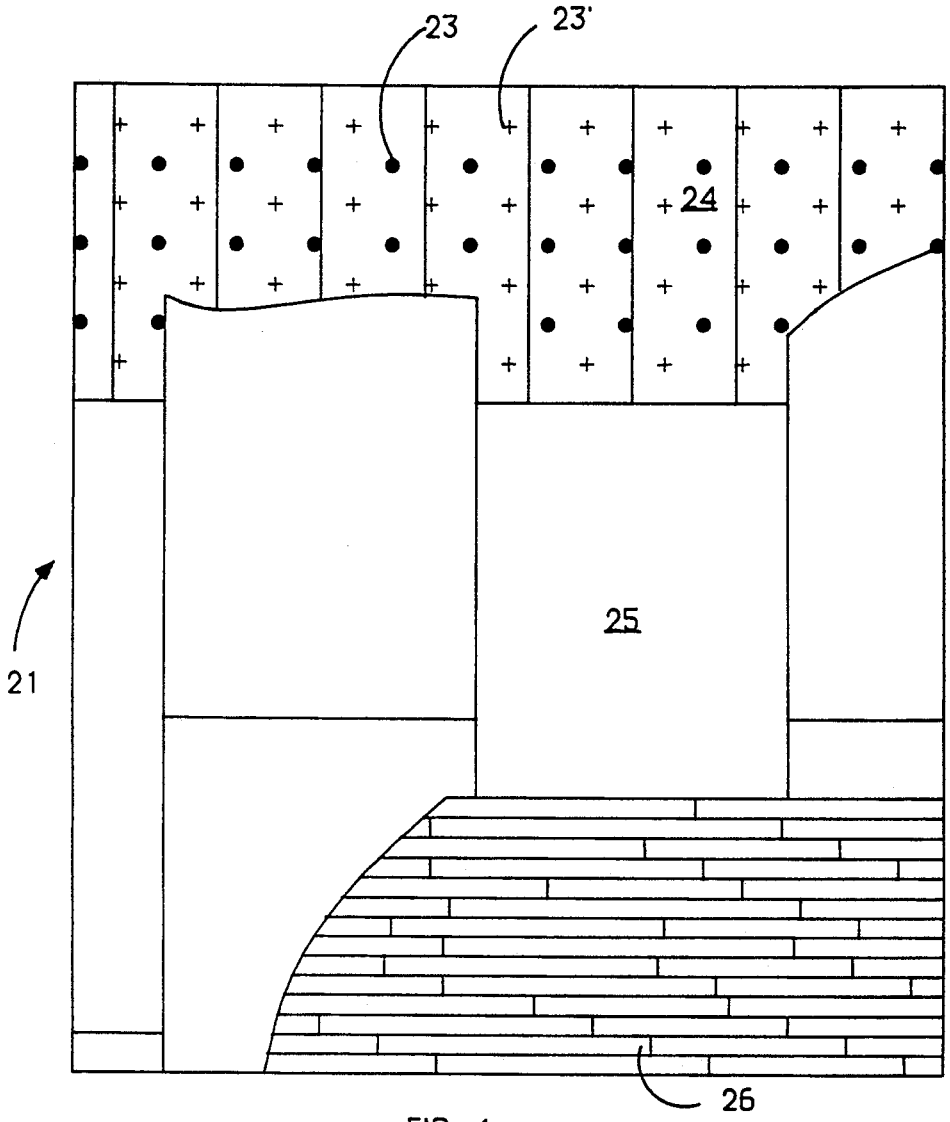
FIG. 4 is a partially sectioned plan view of a second improved flooring system made according to this invention.
Figure 5:
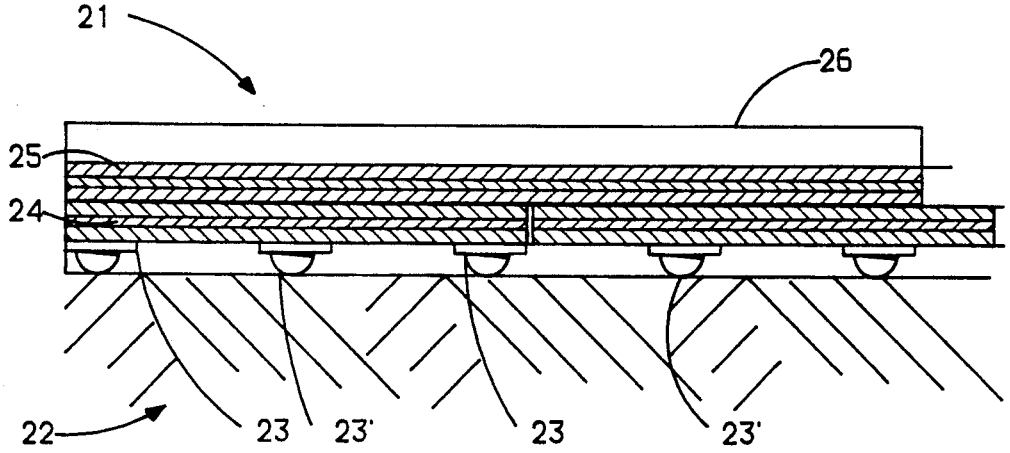
FIG. 5 is an elevational view of the flooring system of FIG. 4.
Figure 6:
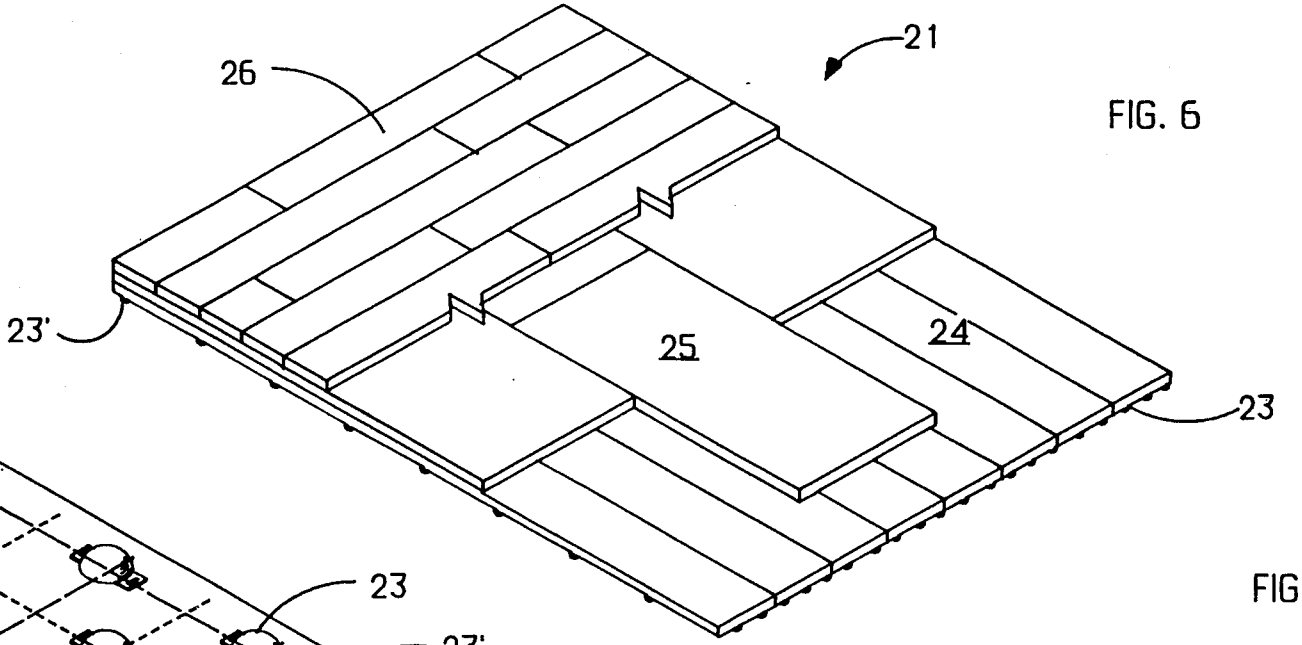
FIG. 6 is a partially sectioned pictorial view of the flooring system of FIGS. 4 and 5.
Figure 8:
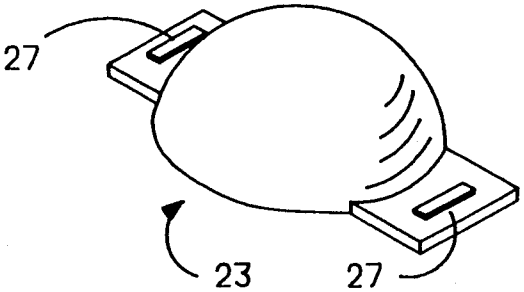
FIG. 8 is an enlarged view of a pad of FIG. 7.

FIGS. 4, 5, and 6 illustrate a flooring system of the second type as described above wherein the first and second subfloors are of plywood and the pad is formed of a multiplicity of individual small pads secured to the bottom of the first subfloor.

In a conventional flooring system of the type contemplated by this embodiment of the invention, the first and second subfloors would typically be of 4' by 8' by ½" plywood sheets. Flooring systems having this configuration have not been found to be DIN certifiable.

However, it has been found that if the plywood thickness is reduced to ⅜" (a 25% reduction in material thickness), and the dimensions of the first subfloor sheets are reduced to 16" in width, which renders the first subfloor less continuous and more flexible than the second subfloor, then a DIN certification is achievable.

Figure 7:
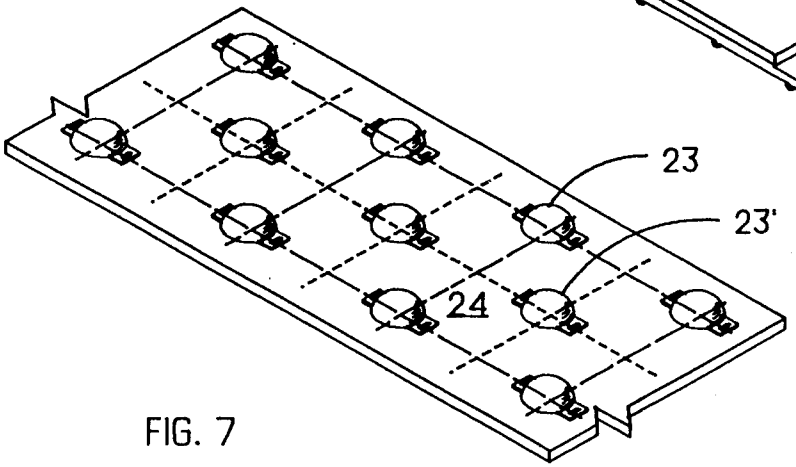
FIG. 7 is a pictorial view of a subfloor member having individual pads secured thereto.

Referring now to FIGS. 4 through 8 wherein a second embodiment of the flooring system of this invention is shown. The positioning of pads 23 is represented by a + symbol in FIG. 4, and pads 23' are represented by a + symbol in FIG. 4, and pads 23 are represented by a blackened O symbol. Pads 23 and 23' are discrete pads secured to the underside of first subfloor 24. Suitable pads are, typically, molded of EDPM rubber to the flooring manufacturer's specifications. In assembly with the subflooring system of this invention, pads 23 and 23' are positioned in two interspersed grid patterns as shown in FIGS. 4 and 7. Typically pads 23 might have a durometer of 60 while pads 23' may have a durometer of 70. Pads 23 and 23' provide a pad layer thickness in the order of ¾".

Flooring system 21 comprises base 22, a pad layer having pads 23 and 23', first subfloor 24, second subfloor 25, and outer floor 26. Pads 23 and 23' are secured to the bottom surface of first subfloor 24 by means of staples 27 and the like. First subfloor 24 and second subfloor 25 are joined by conventional fastening means, not shown. Outer floor 26 is joined to first subfloor 24 and second subfloor 25 by means of conventional fasteners, not shown.

As has been shown, the DIN rating system combines measurements of area elasticity and point elasticity as a combination of measurements of; force attenuation, standard deformation, trough deformation, ball rebound, and rolling load. The flooring systems of this invention are of a traditional construction wherein the sizes, relative positioning, and proportions of the components of the system are in specific critical combinations.

Specifically; the pad height is to be greater than ½" and less than the combined thickness of the first subfloor and the second subfloor with a thickness greater than ½" and less than 1" being preferred and a thickness in the order of ¾" being most preferred.

The first subfloor is to have less continuity than the second subfloor.

The void volume of the system is to be greater in the lower half of the flooring system than it is in the top half of the system.

The thickness of the first subfloor and the thickness of the second subfloor is to be in the range between ⅜" and ¾".

Having disclosed these principles, the applicant has set out specific sizes, proportions, and combinations of materials that represent the best mode of practicing this invention, known to the inventor at the time of the preparation of this disclosure. For each of the two embodiments taught in this disclosure, the sizes and proportions of the elements are different and it is critical that sizes and proportions taught for each embodiment be consistent with each other in order to achieve the desired DIN certifiability at the disclosed reductions in the amount of materials employed in the first and second subfloors.

For the first embodiment;

The pad is to be greater than ⅜" thick and less than 1" thick with ¾" preferred.

The wood boards that make up the first and second subfloors are to be of pine and preferably spruce-pine-fir, and having a thickness between ⅜" and 1" with ½" preferred and the boards having a width of between 4" and 8" with 5½" preferred.

The boards that make up the first subfloor are to be spaced apart between 4" and 8" with 6" preferred, and the boards of the second subfloor are to be spaced apart a distance of between 1" and 3" with 2" preferred.

The boards that make up the first and second subfloors are to intersect each other at an angle of between 40° and 60° with 50° preferred.

For the second embodiment;

The pad heights are to be greater than ⅝" and less than 1" with ¾" preferred.

The plywood is to be less than ½" thick and greater than ¼" thick with ⅜" thick preferred.

The plywood of the first subfloor is to have a width of between 12" and 24" with a width of 16" preferred.

The plywood of the second subfloor is to be a full 4' by 8' sheet.

Having provided an enabling disclosure of the invention, I claim:

1. An athletic flooring system comprising;

a) a multiplicity of elements, each element having a sizing and a positioning in the flooring system, b) a base, c) a resilient pad which rests upon said base, and said pad underlays a first subfloor, and said first subfloor rests upon the pad, and said first subfloor underlays a second subfloor which rests upon said first subfloor, and said pad is of a thickness greater than ½ inch and less than the combined thickness of the two subfloors with which the pad is associated, d) said first subfloor has a thickness greater than ¼ inch and less than ¾ inch, e) said second subfloor has a thickness greater than ¼ inch and less than ¾ inch, and the sizing and positioning of the elements of said first subfloor and said second subfloor are such that the first subfloor is rendered more flexible than the second subfloor, and the base, the pad, the first subfloor and the second subfloor combine to form a substructure for said flooring system, f) and, the substructure has a lower portion and an upper portion and the lower portion comprises the pad, and the first subfloor and the upper portion comprises the second subfloor, and the substructure has void volumes distributed within the substructure and the total volume of the void volumes in the lower portion of the subfloor is greater than the total volume of the void volumes in the upper subfloor, g) an outer floor that rests upon the second subfloor, and h) the flooring system is DIN certifiable under DIN 18032, Part 2 (March 1991) standards.

2. The athletic flooring system of claim 1 wherein, a) the pad is formed of closed cell resilient foam, b) the first subfloor is formed of spruce-pine-fir boards having a width of more than 4 inches and less than 8 inches and the boards are spaced apart from each other a distance greater than 4 and less than 8 inches, c) the second subfloor is formed of spruce-pine-fir boards having a width of more than 4 inches and less than 8 inches, and the boards are spaced apart from each other a distance at least 1 inch and at most 3 inches, and d) the boards of the first subfloor cross the boards of the second subfloor so that the boards of the first subfloor intersect the boards of the second subfloor at an angle of between 40° and 60°.

3. The athletic flooring system of claim 2 wherein;

a) the pad is ¾ inch thick, b) the boards of the first subfloor are ½ inch thick and 5½ inches wide and spaced apart a distance of 6 inches, c) the boards that make up the second subfloor are ½ inch thick and 5½ inches wide and spaced apart a distance of 2 inches and the boards of the first subfloor intersect the boards of the second subfloor at an angle of 50°.

4. The athletic flooring system of claim 1 wherein;

a) the first subfloor has a bottom surface and the pad is in the form of a pad layer which is made up of a multiplicity of discrete pads secured to the bottom surface of the first subfloor and the pad is at least ½ inch thick and at most 1 inch thick, b) the first subfloor is formed of sheets of plywood having a thickness of less than ½ inch and at least ¼ inch and a width of at most 24 inches and at least 12 inches, c) the second subfloor is formed of sheets of plywood having a width of 48 inches and a thickness of less than ½ inch and at least ¼ inch, so as to create a situation wherein the second subfloor is more flexible than the first subfloor.

5. The flooring system of claim 4 wherein;

a) the pad is ¾ inches thick, b) the the plywood sheets that make up the first subfloor are ⅜ inches thick and 16 inches wide, and c) the plywood sheets that make up the second subfloor are ⅜ inches thick and 48 inches wide.

* * * * *